US007344124B2

(12) United States Patent
Hayden

(10) Patent No.: US 7,344,124 B2
(45) Date of Patent: Mar. 18, 2008

(54) WATER CURTAIN APPARATUS AND METHOD

(76) Inventor: John B. Hayden, 4800 Whitehall Dr., Englewood, CO (US) 80111

( * ) Notice: Subject to any disclaimer, the term of this patent is extended or adjusted under 35 U.S.C. 154(b) by 110 days.

(21) Appl. No.: 11/081,735

(22) Filed: Mar. 17, 2005

(65) Prior Publication Data

US 2006/0208368 A1 Sep. 21, 2006

(51) Int. Cl.
*B01F 3/04* (2006.01)

(52) U.S. Cl. ..... 261/36.1; 261/105; 261/106

(58) Field of Classification Search ..... 261/29, 261/36.1, 96, 97, 105, 106, 107, DIG. 3, 261/DIG. 43, 112.1
See application file for complete search history.

(56) References Cited

U.S. PATENT DOCUMENTS

| | | | | | |
|---|---|---|---|---|---|
| 999,114 | A | * | 7/1911 | Lang | 261/106 |
| 1,631,240 | A | * | 6/1927 | Amet | 359/443 |
| 1,689,790 | A | | 10/1928 | Lefevre, Jr. | |
| 1,837,225 | A | | 12/1931 | Lipski | |
| 2,031,055 | A | * | 2/1936 | McKinney | 261/30 |
| 3,174,688 | A | | 3/1965 | Chatten | 239/20 |
| 3,211,378 | A | | 10/1965 | Zysk | 239/20 |
| 3,568,927 | A | | 3/1971 | Scurlock | 239/17 |
| 3,778,042 | A | * | 12/1973 | Schade et al. | 261/105 |
| 3,867,485 | A | * | 2/1975 | Yeagle | 261/7 |
| 4,038,347 | A | * | 7/1977 | Mickley | 261/30 |
| 4,234,526 | A | * | 11/1980 | Mackay et al. | 261/106 |
| 4,329,205 | A | * | 5/1982 | Tsumura et al. | 202/174 |
| 4,351,781 | A | * | 9/1982 | Blatter | 261/29 |
| 4,353,846 | A | * | 10/1982 | Mehrens et al. | 261/4 |
| 4,443,513 | A | | 4/1984 | Meitner et al. | 422/195 |
| 4,615,182 | A | * | 10/1986 | Worthington | 62/310 |
| 4,615,844 | A | * | 10/1986 | Dickison et al. | 261/29 |
| 4,747,538 | A | | 5/1988 | Dunn et al. | 239/20 |
| 4,747,583 | A | | 5/1988 | Gordon et al. | 266/235 |
| 4,881,280 | A | | 11/1989 | Lesikar | 4/507 |
| 5,067,653 | A | | 11/1991 | Araki et al. | 239/18 |
| 5,145,280 | A | | 9/1992 | Araki et al. | 405/62 |
| 5,154,671 | A | | 10/1992 | Smollar et al. | 472/117 |
| 5,167,368 | A | | 12/1992 | Nash | 239/17 |
| 5,226,935 | A | | 7/1993 | Wolff et al. | 55/257.5 |
| 5,288,018 | A | | 2/1994 | Chikazumi | 239/20 |
| 5,313,744 | A | | 5/1994 | Shank, Jr. | 51/317 |
| 5,445,322 | A | | 8/1995 | Formhals et al. | 239/18 |
| 5,537,696 | A | | 7/1996 | Chartier | 4/507 |
| 5,732,419 | A | | 3/1998 | Feist | 4/558 |

(Continued)

OTHER PUBLICATIONS

Tsunami Water Screens, http://www.tsunamiscreen.com/index.htm (5 pp.), Jan. 2006.

(Continued)

*Primary Examiner*—Scott Bushey
(74) *Attorney, Agent, or Firm*—Baker & Hostetler LLP

(57) ABSTRACT

A water curtain is provided which includes a drape assembly having a drape hood, material drape, float overflow shut-off, collection return, a drainage line solenoid which preferably is electric, a drainage line, a filter, drape solenoid which preferably is electric, a drape feed line, a pump, a pump power line, an on/off switch to a power source which preferably is a ground fault circuit interrupter (GFCI) power line for obvious safety concerns, a feed line, and a shutoff valve. The water supply may be electrically controlled by solenoid valves and has a float overflow shutoff control in some embodiments.

12 Claims, 5 Drawing Sheets

U.S. PATENT DOCUMENTS

| | | | | |
|---|---|---|---|---|
| 5,738,280 | A | 4/1998 | Ruthenberg | 239/17 |
| 5,794,318 | A | 8/1998 | Parker et al. | 27/1 |
| 6,149,070 | A | 11/2000 | Hones | 239/17 |
| 6,152,381 | A | 11/2000 | Hones | 239/17 |
| 6,311,898 | B1 | 11/2001 | Gruff | 239/17 |
| 6,347,750 | B1 | 2/2002 | Delettre | 239/17 |
| 6,382,520 | B1 | 5/2002 | Hones | 239/12 |
| 6,527,257 | B1 | 3/2003 | Schuld | 261/29 |
| 6,626,368 | B2 | 9/2003 | Nakayama et al. | 239/22 |
| 6,731,429 | B2 | 5/2004 | Lunde | 359/443 |
| 7,066,452 | B2 * | 6/2006 | Rotering et al. | 261/142 |
| 2001/0018776 | A1 | 9/2001 | Koren et al. | 4/507 |
| 2001/0055516 | A1 | 12/2001 | King et al. | 405/28 |

OTHER PUBLICATIONS

Beamin' Lasers, http://www.beaminlasers.com (3 pp.), Jan. 2006.
"Rainshadow Waterwalls", http://www.rainshadowaterwalls.com, (date Oct. 9, 2006), pp. 1-2.
"Water Wall", manufactured by Kabana Kascade, RainShadow-WaterWalls.com, (date Apr. 16, 2007), 8 pages.

* cited by examiner

WATER CURTAIN APPARATUS AND METHOD

FIELD OF THE INVENTION

The present invention relates generally to a water curtain apparatus. More particularly, the present invention relates to a film or sheet-type water curtain apparatus and method.

BACKGROUND OF THE INVENTION

Water from a reservoir running over a dam, in such a manner as to create a dispersion, is noted to produce aesthetically and acoustically pleasing effects, including a cooling effect as well as a change in humidity in areas nearby.

It is noted that this same effect can be duplicated in an artificial waterfall by using a thin angled panel, and allowing water to run down the panel. This panel may also have indentures that cause a rippling effect in the falling water.

Cooling our dwellings and workspace today is comprised of two subgroups primarily, heat exchange and evaporative cooling. Heat exchange air conditioning, the most popular, consumes large amounts of electricity, and uses chemicals to transport heat that are considered potentially harmful to the environment.

In addition, heat exchange releases excess heat back into the environment, but recycles the same air over and over again. The "swamp" evaporative cooler is effectively a box containing a fan that draws air through saturated pads to provide cooling and a pump to keep the pads moist. It has remained the same for many decades.

A variation of these subgroups uses evaporation to cool a heat exchanger then passes the cooled air through wet pads, thus reducing humidity. Limitations are inherent to ambient humidity reducing efficacy, and the large volumes of air that must be moved. The use of evaporative cooling and air conditioning when run simultaneously in an area cancel out their cooling benefits, since one introduces humidity and the other removes humidity. Neither of these will work in a passive way since both require energy from an external source.

The recent popularity of misting systems shows that a need for cooling outdoor areas is desirable. These however release large volumes of water into the air and can saturate objects nearby. They are additionally prone to clogging due to mineralization and since they rely on high pressure to mist flooding can occur if compromised.

Furthermore, indoor air purification systems require constant cleaning and electricity to function. These systems only clean air once it is inside by recirculation.

Waterfalls such as those represented by the prior art allow water to collect in an upper reservoir, flow down an angled surface, and collect in a lower reservoir. The water is then re-circulated to the upper reservoir using a pump means, whereby the cycle may repeat.

U.S. Pat. No. 5,167,368 to Nash shows a waterfall providing a natural waterfall effect with accompanying acoustical effects.

U.S. Pat. No. 3,211,378 to Zysk is a wall fountain having a pool of water and a pump for raising water from the pool to a higher lever where it then falls over a vertical wall back into the pool.

The waterfalls described previously, and others like them, all suffer from a number of distinct disadvantages, such as considerable water droplet splashing over a range of several feet from the base of the waterfalls; significant evaporation of water to the point that refill may be required daily; risk of water spillage during relocation of the waterfall; and a large base to house a lower reservoir and a means for returning water to the upper reservoir.

Moreover, conventional decorative water or waterfall displays are typically constructed for indoor or outdoor use. These water or waterfall displays generally use a plurality of water chambers and wide, flat spouts to create thick and discontinuous streams of water that fall a short distance into the pool or spa below. One of the problems with such devices is that they are primarily designed for use with large volumes of water, which makes it difficult to use the devices in indoor water displays. Moreover, such prior art waterfall displays do not form a continuous film or layer of downwardly flowing water, but rather form thick, turbulent streams which tend to splash and are not particularly attractive as a decorative display. Additionally, the waterfall produced by such devices tends to separate into one or more generally cylindrical streams of water as it falls because of the strong surface tension of water that tends to pull the water flow together. Examples of such devices are disclosed in U.S. Pat. No. 4,881,280 to Lesikar; U.S. Pat. No. 5,537,696 to Chartier; and U.S. Pat. No. 5,738,280 to Ruthenberg.

Decorative indoor water displays are known in the art. However, the known indoor water displays do not create an unsupported film or laminar sheet of water. Instead, such displays are characterized by flowing water over a solid or broken solid surface, such as an inclined or vertical plate. The water adheres to the plate surface as it cascades down. Such displays do not create a transparent film of water, but merely flow water over an existing structure to create a rippling effect. An example of such a device is disclosed in U.S. Pat. No. 4,747,583 to Dunn et al.

Indoor displays that are used to advertise oil are known in the art. One of the problems associated with the existing advertising display devices is that in order to function, they require the use of viscous fluids, such as lubricating oil. U.S. Pat. No. 1,689,790 to Lefevre, Jr. discloses an oil display device. Lefevre, Jr. however, is limited to maintaining a thin film of viscous liquid. The device relies on the high viscosity of the liquid displayed to create a film. Another problem associated with the Lefevre, Jr. device is that in order to maintain contact between the viscous liquid and two guides, it relies on forming the guides such that they converge at the bottom of the device. As a result of these deficiencies, the device disclosed would not be able to maintain a film of aqueous liquid. Similarly, U.S. Pat. No. 1,837,225 to Lipski discloses an oil display device for displaying cyclic movement of an oil film, and is adapted for use only with lubricating oils and other liquids with high molecular adhesion. The Lipski device is similarly not suited for low viscosity liquids, such as water or aqueous liquids which have low molecular adhesion and high molecular cohesion.

The creation of water screens is not new and numerous procedures are already in use. However the apparatus and materials conventionally implemented present major drawbacks due to complexity of operation, restrictive dimensions, low mechanical ruggedness, bad endurance over time and vulnerability to bad weather.

Accordingly, until now the proposed systems fail to meet a certain number of requirements.

In contrast, the present invention presents a high degree of flexibility in terms of size and shape, and offers a great mobility at low construction and maintenance costs.

The adaptability of the process is based on a combination of several significant innovations, such as air permeability and visual transparency thanks to the size of the net mesh;

large span construction scalable in terms of both height and width lightness and tolerance thanks to multiple adjustment points; and low volume reservoirs thanks to a maximum water spread.

Furthermore, it is well known to capture paint overspray whether as a liquid or as a powder by use of water curtains which are placed behind the substrate being painted. The water curtains are provided by directing water downward on a flat support to form a coherent sheet of water which catches the paint particles or droplets. Similarly, the present invention may be configured to passively filter air by placing the water curtain across an opening or passageway allowing filtered air to pass through while increasing its humidity, providing cooling effects and reducing the particulate matter therein.

The devices disclosed in the aforementioned patents suffer from many deficiencies as described above. Accordingly, it is desirable, therefore, to provide a decorative, useful and educational indoor or outdoor waterfall/water curtain which utilizes a low viscosity liquid, such as water or other aqueous liquid, to form an attractive display of a continuous liquid film along a material drape between two limiting elements. From the standpoint of education, it would be desirable to provide a waterfall device that is not only decorative, but also is suitable for use as a demonstrative aid in teaching the physics of liquid flow, surface tension and other hydrodynamic concepts.

SUMMARY OF THE INVENTION

The foregoing needs are met, to a great extent, by the present invention, wherein in one aspect an apparatus is provided that in some embodiments may include a decorative, useful and educational indoor waterfall which utilizes a low viscosity liquid, such as water or other aqueous liquid, to form an attractive display of a continuous liquid film along a material drape between two limiting elements.

In accordance with one aspect of the present invention, a humidifier and fountain apparatus is provided comprising a drape hood; a collection return; a material drape disposed between the drape hood and the collection return; and a pump in fluid communication with a fluid source, wherein the material drape is suspended within the drape hood and the pump is in fluid communication via feed lines to the collection return. The apparatus further comprises a float overflow shut-off disposed within the collection return; a filter; and a power source, wherein the filter is inline with the pump and the power source electrically power the pump and the drape hood covers a piston assembly which is in fluid communication with the pump. The piston assembly comprises a piston sleeve having a distal end and an opposing end proximal the pump and wherein the piston sleeve encases a piston configured for movement while under fluid pressure. The piston assembly further comprises a magnetic collar disposed proximal the distal end to attract the piston; an elastic cord for retracting the piston is attached at one end of said piston and at the opposing end to an anchor; a gutter connected beneath said piston sleeve; and a drape material track connected beneath said gutter and configured to hold said material drape in suspension while permitting fluid to pass onto said material drape, wherein said gutter has a longitudinal drainage slit along its length.

In accordance with another aspect of the present invention, a method for humidifying and cooling is provided comprising suspending a material drape within an air stream between a drape hood and a catch basin; pumping an aqueous fluid from a fluid source to the drape hood; causing the pumped fluid to flow down the material drape; catching the fluid from the material drape; filtering the fluid; and returning the caught fluid back to the pump for recirculation to the drape hood.

In accordance with still another aspect of the present invention, a decorative humidifier and fountain apparatus is provided comprising means for suspending a material drape within an air stream between a drape hood and a catch basin; means for pumping an aqueous fluid from a fluid source to the drape hood; means for causing the pumped fluid to flow down the material drape; means for catching the fluid from the material drape; means for filtering the fluid; and means for returning the caught fluid back to the pump for recirculation to the drape hood.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
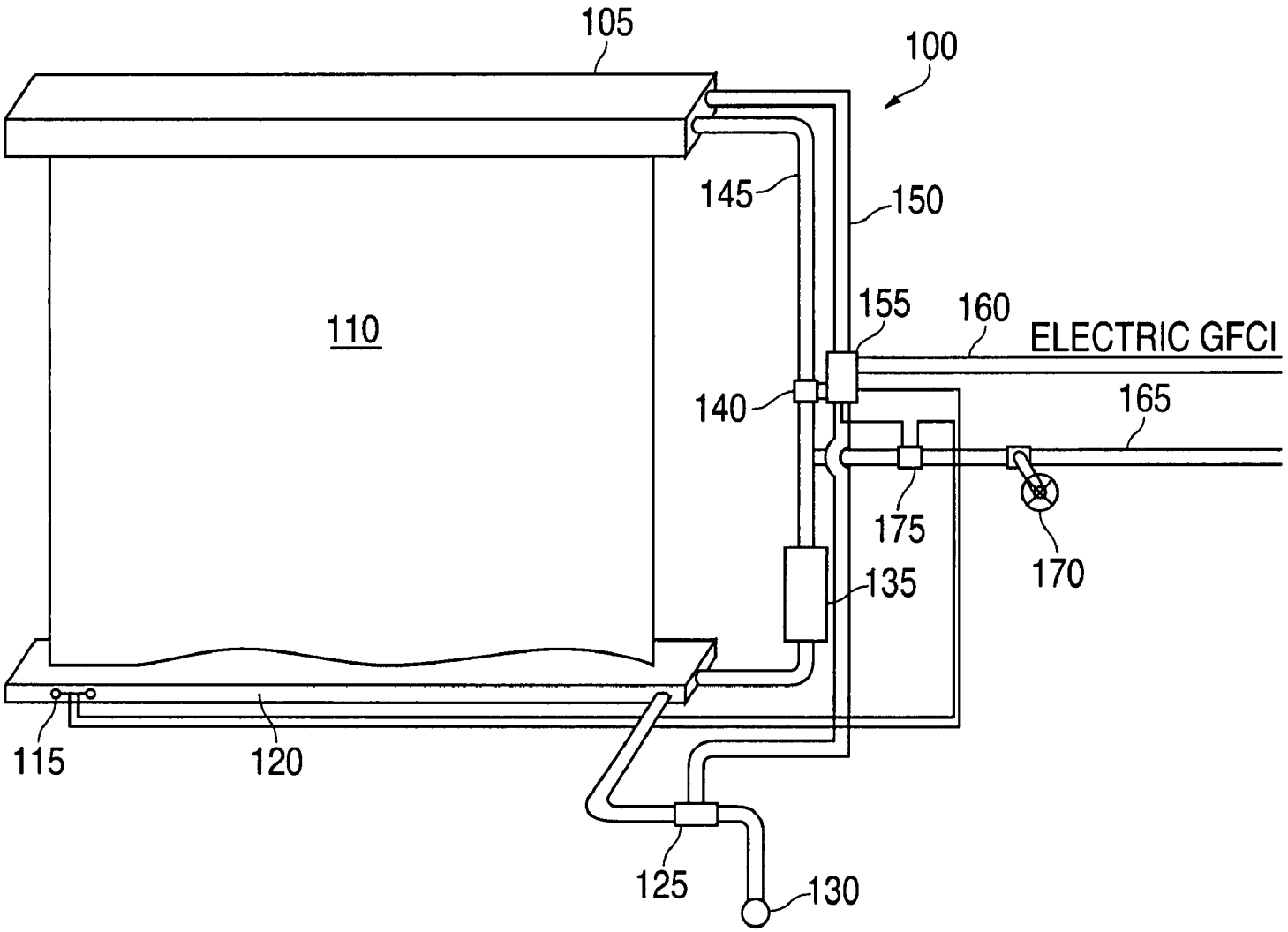
FIG. 1 is a diagrammatic representation of a water curtain apparatus according to a preferred embodiment of the invention.

The invention will now be described with reference to the drawing figures, in which like reference numerals refer to like parts throughout. As shown in FIG. 1, an embodiment in accordance with the present invention provides a water curtain or drape assembly 100 having a drape hood 105, material drape 110, float overflow shut-off 115, collection return 120, a drainage line solenoid 125 which preferably is electric, a drainage line 130, a filter 135, drape solenoid 140 which preferably is electric, a drape feed line 145, a pump 240, a pump power line 150, an on/off switch 155 to a power source 160 which preferably is a ground fault circuit interrupter (GFCI) power line for obvious safety concerns, a feed line 165, and a shutoff valve 170.

The present invention, wherein in one aspect provides that in some embodiments may include a decorative, useful and educational indoor waterfall which utilizes a low viscosity liquid, such as water or other aqueous liquid, to form an attractive display of a continuous liquid film along a material drape 110 between two limiting elements 105, 120. The material drape 110 may be a thin fabric sheet. The material drape 110 may be porous or semi-porous and preferably made of a fiber glass mesh fabric.

Figure 2A:
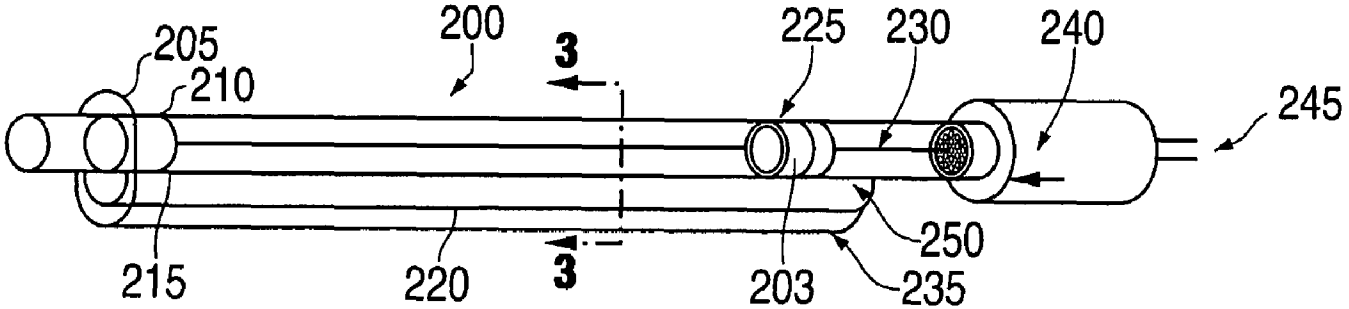
FIG. 2A is a diagrammatic representation of a piston assembly according to a preferred embodiment of the invention.
Figure 2B:
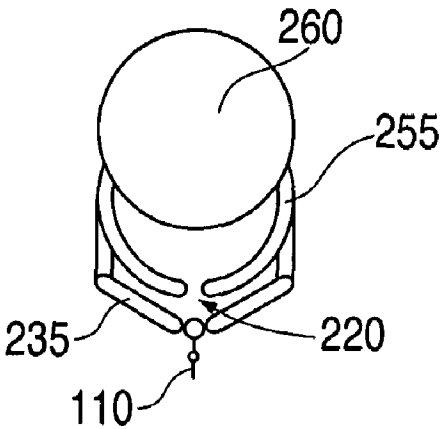
FIG. 2B is a cross-sectional view taken along the 3-3 in FIG. 2A.

An embodiment of the present inventive apparatus and method is illustrated in FIGS. 1, 2A and 2B, wherein the material drape 100 is disposed within the hood 105 and suspended from the hood 105 towards the collection return 120. As water or other aqueous liquid is fed from feed line 165 to the drape feed line 145 into the hood 105, pump 240 via intake 245 pumps the water or other aqueous liquid into piston assembly 200 having a piston 203, a magnetic collar 205, a piston open position at 210, a gutter 255, a gutter drain slit 215, a gutter groove 220, a piston closed position at 225, an elastic cord 230 attached to piston 203, a drape material track 235, gutter drain 250, and a piston sleeve 260.

The pumped liquid then pressurizes piston sleeve 260 thereby causing piston 203 to move longitudinally along sleeve 260 from the closed position 225 to the open position 210. The magnetic collar 205 may in effect assist in pulling the piston 203 to the open position by using a reverse polarity magnetic collar 205 to attract the piston 203. The elastic cord 230 assists in returning the piston to the closed position 225 upon the reduction or removal of liquid pressure within the piston sleeve 260 accordingly. Drain 250 allows liquid located between the pump 240 and piston 203 at the closed position 225 to be exhausted. Drain slit 215 allows liquid to flow from the piston sleeve 260 into the gutter 255 via the gutter groove 220 and into the material track 235. Once the liquid begins to fill the material track 235, liquid will accumulate and flow upon the material drape 110 disposed within the track 235 in the direction of the collection return 120.

The water or other aqueous liquid may flow downward over the material drape 110 and through one side or both sides of the material drape 110, including a wicking effect for upward and downward flows while allowing ambient air to pass through. It should be noted that if a laminar flow of water or other aqueous liquid over the surfaces of the material drape 110 is created or controlled by the speed or velocity of pump 240, evaporation will occur, but the excess moisture while slightly restricting or controlling air movement will have the added benefit of "scrubbing" the air as it moves through the flowing water. This benefit may reduce pollutants, allergens, insects and the like. The gutter 255 may be filled manually without the use of pump 240 in some embodiments (not shown). The collection return 120 may either be independent or attached to a recirculation system as shown. The inline filter 135 may remove contaminants picked up during the movement of the water or other aqueous liquid.

An ionizing element (not shown) may be incorporated inline to create pH changes in the water or other aqueous liquid for sterilizing purposes.

The drape 110 may be mounted for vertical or horizontal movement or retraction or mounted in a fixed manner. If vertically mounted, the drape 110 may roll to the side or fold when not being utilized. If horizontally mounted as shown in FIG. 1, the drape 110 may roll or fold upward or downward with respect to the horizontal.

The drape assembly 100 may include an inline heating element (not shown) to increase the temperature of the water or other aqueous liquid.

Figure 3:
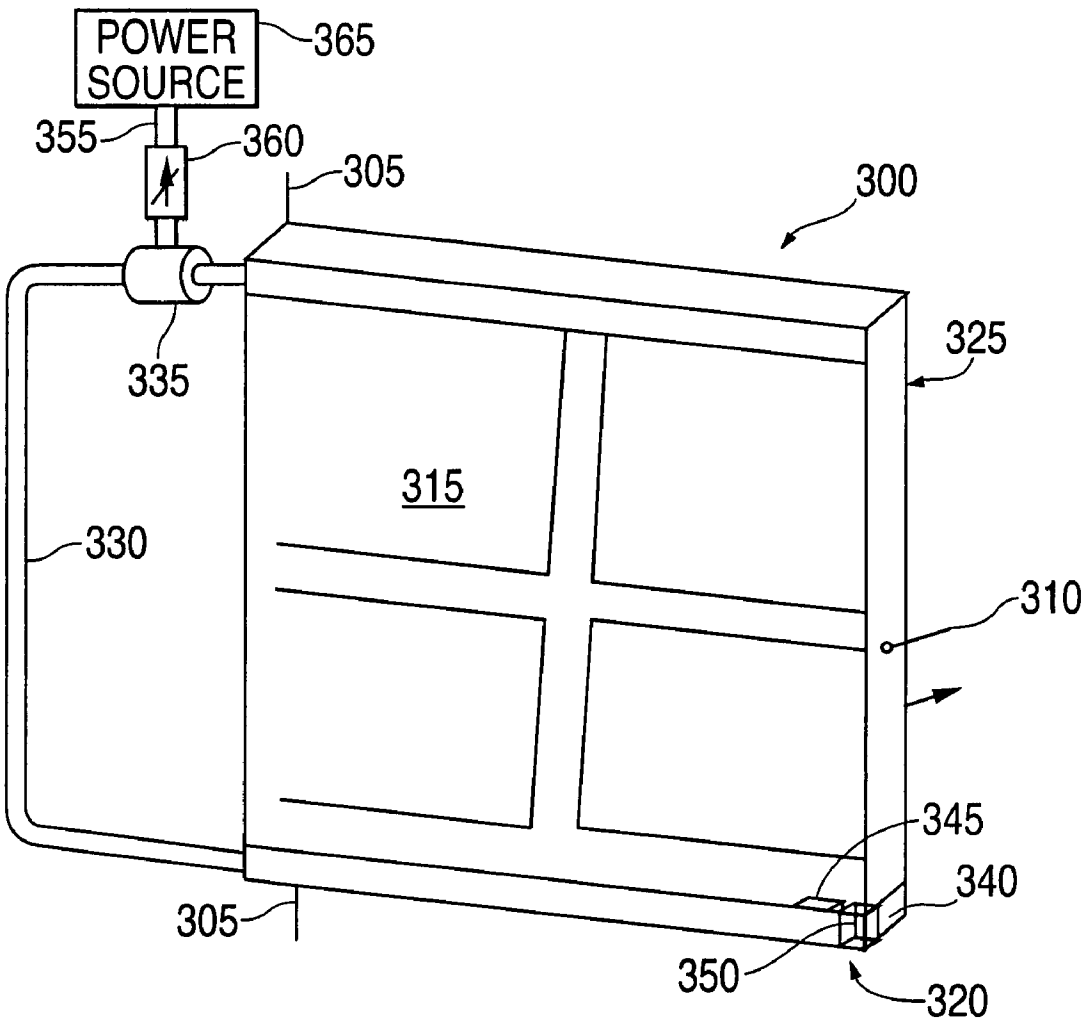
FIG. 3 is a perspective view in accordance with an embodiment of the invention.

Referring to FIG. 3, an embodiment of the present inventive apparatus and method provides a pivotal window drape assembly 300 having pivot hinges 305, a latch 310, a fixed screen drape material 315, a drain opening 320, mounting frame 325, tubing 330, a high volume pump 335, collection tray 340, collection tray float 345, overflow float valve 350, solenoid reservoir drain 355, a pump power line 360, an on/off switch 365 to a power source 370 which preferably is a GFCI power line.

In this embodiment the window drape assembly 300 opens inwards within a building or structure and utilizes a high volume pump 335 to create a waterfall effect upon the fixed screen material 315. This waterfall effect provides for a degree of privacy as well as a measurable amount of humidity to interior spaces as air may be allowed to pass.

Figure 4:
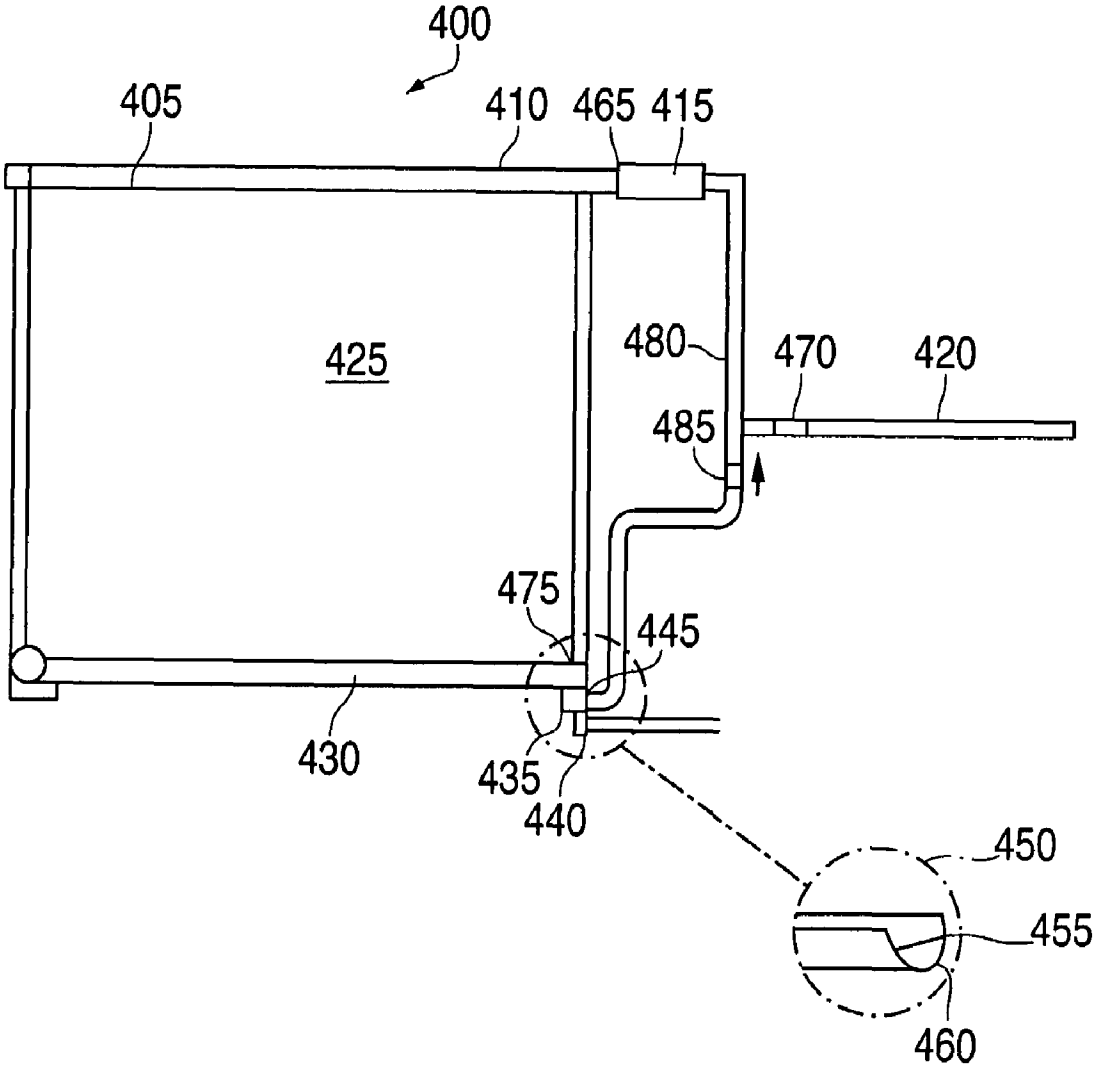
FIG. 4 is a diagrammatic representation in accordance with an embodiment of the invention.

Referring to FIG. 4, an embodiment of the present inventive apparatus and method provides a walled drape assembly 400 having a slit 405; a gutter 410; a pump 415; a water main 420; a material drape 425; a reservoir/catch basin 430 having sidewalls 450, drainage openings 460 and an overflow level indicator 455; a float 435; a catch basin solenoid drain 440; a catch basin overflow region 445; a swivel pump connector 465; a water main solenoid 470; a pump contact switch 475; a feed line 480; and a one-way valve 485.

The walled drape assembly 400 is configured to be set back into a wall. The swivel connector 465 allows for some flexibility in setting the assembly 400 into a well as desired. The contact switch 475 turns on the pump 415 either manually or remotely as desired. The water main 420 provides water or other aqueous liquid to the pump 415 and is controlled by solenoid 470. The catch basin 430 retrieves and circulates the water or other aqueous liquid via the feed line 480. There is a one-way valve disposed inline with the feed line 480 to prevent backflow to the catch basin 430. The catch basin 430 utilizes a solenoid drain 440 in combination with float 435 to sense and prevent overflow conditions of the basin 430. The gutter 410 receives the liquid from pump 415 and the liquid subsequently flows from slit 405 onto drape 425 accordingly. The drape 425 may be retractable by use of an elastic spring or stock spring or both (not shown) depending on the size and length of the drape 425 used. A manually operated embodiment has no pump but may use a seeper hose which moistens the drape 425 and then fills the catch basin 430. However, the catch basin 430 may overflow and therefore requires manual draining via drain 440.

Figure 5:
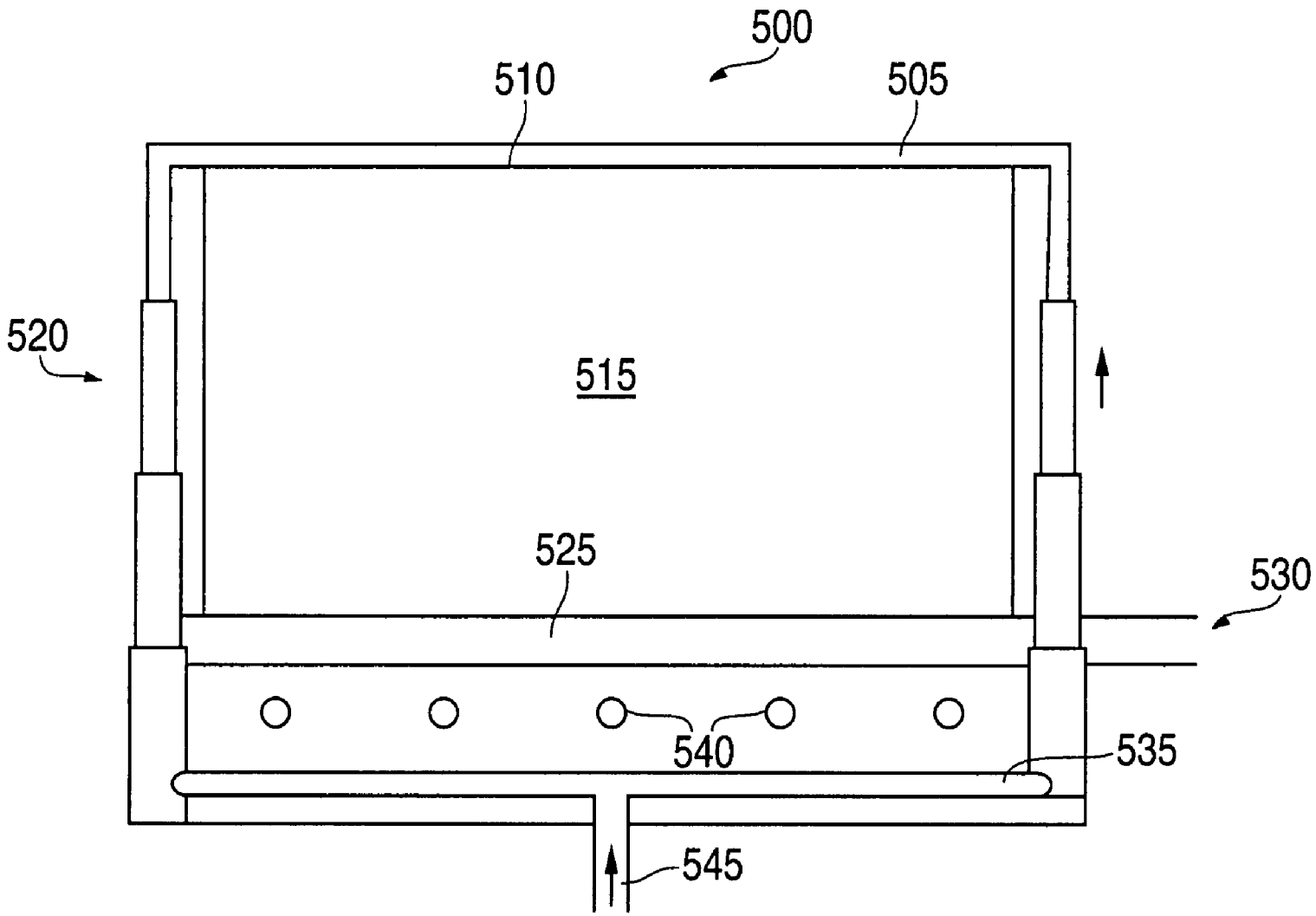
FIG. 5 is a diagrammatic representation of an embodiment of the invention.

Referring to FIG. 5, an embodiment of the present inventive apparatus and method provides a water curtain assembly 500 having a water gutter 505, a water drainage slit 510, a material drape 515, hydraulic telescopic piston sleeves 520, a drape storage cavity 525, a water inlet 535, a plurality of return drains 540, and a diverter pump or dedicated pump 545 as desired.

The connection between the water gutter 505 and the piston sleeves 520 may be configured at a ninety degree angle thereby reducing the flow of water or other aqueous liquid to gutter 505 and subsequently to slit 510. This embodiment may be applicable to hot tubs and the like. A diverter pump or dedicated pump 545 may provide pressurized water for a hot tub or other primary source 530 to piston sleeves 520 thereby causing the sleeves 520 to expand telescopically from an initial position to a desired height or length. As the piston sleeves 520 expand, the drape 515 may freely unravel and move upward with the sleeves 520. The water or other aqueous liquid will propagate within the sleeves 520 into the gutter 505 and out the slit 510 upon the drape 515 creating a water curtain effect. When the water pressure from the pump lessens or ceases the piston sleeves 520 will lower and return to the initial position and the drape 515 will reside and be disposed within storage cavity 525 accordingly. The water or other aqueous liquid propagating down the drape 515 may be recycled through a plurality of return drains 540 back to the hot tub or primary source 530.

Although an example of the water curtain is shown using a preferably fiber glass mesh drape, it will be appreciated that other structured materials can be used. Also, although the water curtain is useful to increase humidity in the air flow it can also be used to create insect barriers, sound baffling or barriers, privacy screens or fences, reflect indirect light, grab dust or allergens, perform active cooling with forced air flows, and/or passive cooling with air flows alone.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A decorative humidifier and fountain apparatus, comprising:

means for suspending a material drape below a gutter groove, the drape being a translucent fabric sheet within an air stream between a drape hood and a catch basin;

means for pumping an aqueous fluid from a fluid source to the drape hood;

means for causing substantially all of the pumped fluid used for cooling to flow through the gutter groove and down at least part of the material drape;

means for catching the fluid from the material drape;

means for returning the caught fluid back to the pump for recirculation to the drape hood;

wherein the drape is substantially exposed and substantially not enclosed by a housing;

a float overflow shut-off disposed within the means for catching the fluid;

a filter; and a power source, wherein said filter is inline with the means for pumping and said power source electrically power the means for pumping, wherein said pump is disposed within said drape hood.

2. The apparatus of claim 1, wherein said material drape is a fiber glass mesh fabric.

3. The apparatus of claim 1, wherein the air stream is flow controlled.

4. The apparatus of claim 1, wherein the fluid flows and a front and back surface of the fabric sheet.

5. The apparatus of claim 1, wherein said power source is a ground fault circuit interrupter power line.

6. The apparatus of claim 5, wherein said power line has an on/off switch.

7. The apparatus of claim 1, wherein said means for catching the fluid is connected to a drainage solenoid.

8. The apparatus of claim 7, wherein said drainage solenoid is connected upstream to a drainage line.

9. A decorative humidifier and fountain apparatus, comprising:

means for suspending a material drape below a gutter groove, the drape being a translucent fabric sheet within an air stream between a drape hood and a catch basin;

means for pumping an aqueous fluid from a fluid source to the drape hood;

means for causing substantially all of the pumped fluid used for cooling to flow through the gutter groove and down at least part of the material drape;

means for catching the fluid from the material drape; and means for returning the caught fluid back to the pump for recirculation to the drape hood;

wherein the drape is substantially exposed and substantially not enclosed by a housing, wherein said drape hood covers a piston assembly which is in fluid communication with the pump.

10. The apparatus of claim 9, wherein the piston assembly comprises a piston sleeve having a distal end and an opposing end proximal the pump and wherein the piston sleeve encases a piston configured for movement while under fluid pressure.

11. The apparatus of claim 10, wherein the piston assembly further comprises:

a magnetic collar disposed proximal the distal end to attract the piston;

an elastic cord for retracting the piston is attached at one end of said piston and at the opposing end to an anchor;

a gutter connected beneath said piston sleeve; and a drape material track connected beneath said gutter and configured to hold said material drape in suspension while permitting fluid to pass onto said material drape, wherein said gutter groove is a longitudinal drainage slit along the length of the gutter.

12. A decorative humidifier and fountain apparatus, comprising:

means for suspending a material drape below a gutter groove, the drape being a translucent fabric sheet within an air stream between a drape hood and a catch basin;

means for pumping an aqueous fluid from a fluid source to the drape hood;

means for causing substantially all of the pumped fluid used for cooling to flow through the gutter groove and down at least part of the material drape;

means for catching the fluid from the material drape; and means for returning the caught fluid back to the pump for recirculation to the drape hood;

wherein the drape is substantially exposed and substantially not enclosed by a housing, wherein the fabric sheet is positioned and configured to substantially block a view through a window so that most to the light entering a room from the window passes through the fabric sheet;

a pivot hinge mounted to the apparatus for permitting the apparatus to be pivotally mounted adjacent to the window; and a latch for releasablely securing the apparatus in a position.

* * * * *